US007479359B2

(12) United States Patent
Inagaki et al.

(10) Patent No.: US 7,479,359 B2
(45) Date of Patent: Jan. 20, 2009

(54) PHOTOCONDUCTOR FOR ELECTROPHOTOGRAPHY

(75) Inventors: Keiichi Inagaki, Hino (JP); Masao Asano, Tokyo (JP); Hiroshi Yamazaki, Hachioji (JP); Hideo Yoshizawa, Fuchu (JP); Akihiko Itami, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 179 days.

(21) Appl. No.: 11/125,733

(22) Filed: May 10, 2005

(65) Prior Publication Data

US 2005/0255394 A1 Nov. 17, 2005

(30) Foreign Application Priority Data

May 14, 2004 (JP) ..... 2004-145259

(51) Int. Cl.
*G03G 5/09* (2006.01)

(52) U.S. Cl. ..... 430/59.4; 399/159

(58) Field of Classification Search ..... 430/59.4; 399/159

See application file for complete search history.

(56) References Cited

U.S. PATENT DOCUMENTS

| | | | | |
|---|---|---|---|---|
| 5,456,998 | A * | 10/1995 | Burt et al. | 430/58.8 |
| 5,981,745 | A * | 11/1999 | Yamasaki et al. | 540/140 |
| 6,017,666 | A * | 1/2000 | Nealey et al. | 430/59.4 |
| 6,492,080 | B1 * | 12/2002 | Burt et al. | 430/59.4 |
| 2001/0031409 | A1 * | 10/2001 | Sasaki et al. | 430/56 |
| 2003/0152854 | A1 * | 8/2003 | Kojima et al. | 430/58.05 |
| 2003/0232262 | A1 * | 12/2003 | Yamada et al. | 430/58.2 |
| 2004/0063013 | A1 * | 4/2004 | Hongo et al. | 430/59.1 |

FOREIGN PATENT DOCUMENTS

| | | |
|---|---|---|
| JP | 4-184452 | 7/1992 |
| JP | 7-53892 | 2/1995 |
| JP | 7-56372 | 3/1995 |
| JP | 10-88023 | 4/1998 |
| JP | 2000-219817 | 8/2000 |
| JP | 2000-267303 | 9/2000 |
| JP | 2000-284513 | 10/2000 |
| JP | 2001-115054 | 4/2001 |
| JP | 2002-40692 | 2/2002 |
| JP | 2002-91028 | 3/2002 |
| JP | 2004-2874 | 1/2004 |
| JP | 2004-78141 | 3/2004 |
| JP | 2004-126357 | 4/2004 |

OTHER PUBLICATIONS

Written Notice of Ground of Rejection for Japanese Patent Application No. 2004-145259 mailed Jan. 15, 2006 with English translation.

* cited by examiner

*Primary Examiner*—Christopher RoDee
*Assistant Examiner*—Peter L Vajda
(74) *Attorney, Agent, or Firm*—Cantor Colburn LLP

(57) ABSTRACT

A photoconductor for electrophotography, includes a conductive substrate; a photosensitive layer containing charge generation material formed on the conductive substrate. The charge generation material contains a substituted or unsubstituted gallium phthalocyanine dimer (GaPhC dimmer) and a substituted or unsubstituted hydroxy gallium phthalocyanine (GaPhC monomer) and has distinctive diffraction peaks at the Bragg angles (2θ±0.2) of 7.5° and 28.3° in a Cu-Kα characteristic X-ray diffraction spectrum.

18 Claims, 2 Drawing Sheets

PHOTOCONDUCTOR FOR ELECTROPHOTOGRAPHY

BACKGROUND OF THE INVENTION

The present invention relates to a photoconductor for electrophotography, a manufacturing method for the photoconductor, an image forming method using the photoconductor, an image forming apparatus and a process cartridge for image forming.

Background of the Invention compounds are used as photoconductive materials for forming a There has been known that various phthalocyanine photosensitive layer of a photoconductor for electrophotography.

For example, there has been proposed that a photosensitive layer is formed by crystal hydroxy gallium phthalocyanine, and it has been reported that high sensitivity characteristics are obtained by a photoconductor for electrophotography having the aforesaid photosensitive layer (e.g., see Patent Document 1).

It is further known that gallium phthalocyanine dimer is used as a photoconductive material for forming a photosensitive layer, and for example, satisfactory sensitivity characteristics and excellent durability for recurrence are obtained by a photosensitive layer formed by the use of μ-oxo gallium phthalocyanine dimer having a specific diffraction peak in X-ray diffraction spectrum (e.g., see Patent Document 2).

It is further known that stabilized potential-holding characteristics can be obtained by a photosensitive layer formed by phthalocyanine compound containing a specific rate of metal phthalocyanine dimmer (e.g., see Patent Document 3).

(Patent Document 1) TOKKAIHEI No. 7-53892

(Patent Document 2) TOKKAIHEI No. 10-88023

(Patent Document 3) TOKKAI No. 2000-284513

In general, a photosensitive layer in manufacture of a photoconductor for electrophotography can be formed favorably, by means of a way wherein dispersions are compounded by dispersing photoconductive materials in a solvent together with appropriate binder resins, for example, and the dispersions are coated on a conductive substrate.

Though the dispersions having high stability of the state of dispersion can be obtained because crystal hydroxy gallium phthalocyanine itself has excellent dispersibility, this photosensitive layer formed by photoconductive materials has a problem that a decline of sensitivity characteristic in repeated use is relatively great and it is impossible to obtain sufficient stability of charged potential for a long time, because memorability of hysteresis in an image forming process is great.

On the other hand, metal phthalocyanine dimmer is a preferable photoconductive material on the point that the photosensitive layer obtained becomes one having a stable electrophotographic power. However, it has been cleared that the photoconductive material has a problem that a photosensitive material having excellent characteristics cannot be formed, and image defects such as image bleeding and black spots tend to appear on a visible image formed, because dispersibility of the photoconductive material is low, and the photoconductive material tends to coagulate again even in the case of obtaining the state of dispersion once.

To improve the state of dispersion in the dispersions, it is usually effective to add dispersing agents such as surface active agents. However, when surface active agents are added to the dispersions for photoconductive materials for forming a photosensitive layer, an appropriate photoconductor for electrophotography cannot actually be obtained, because an electrophotographic power of the photosensitive layer obtained is adversely affected by the surface active agents greatly.

SUMMARY OF THE INVENTION

In a photoconductor for electrophotography, a photosensitive layer containing charge generation material is formed on a conductive substrate, and the charge generation material contains a substituted or unsubstituted gallium phthalocyanine dimer and a substituted or unsubstituted hydroxy gallium phthalocyanine and has distinctive diffraction peaks at the Bragg angles (2θ±0.2) of 7.5° and 28.3° in the Cu-Kα characteristic X-ray diffraction spectrum.

Another aspect is an image forming apparatus including the above described photoconductor.

Another aspect is a process cartridge for use in the image forming apparatus including the above described photoconductor.

DETAILED DESCRIPTION OF THE EXEMPLARY EMBODIMENTS

Figure 1:
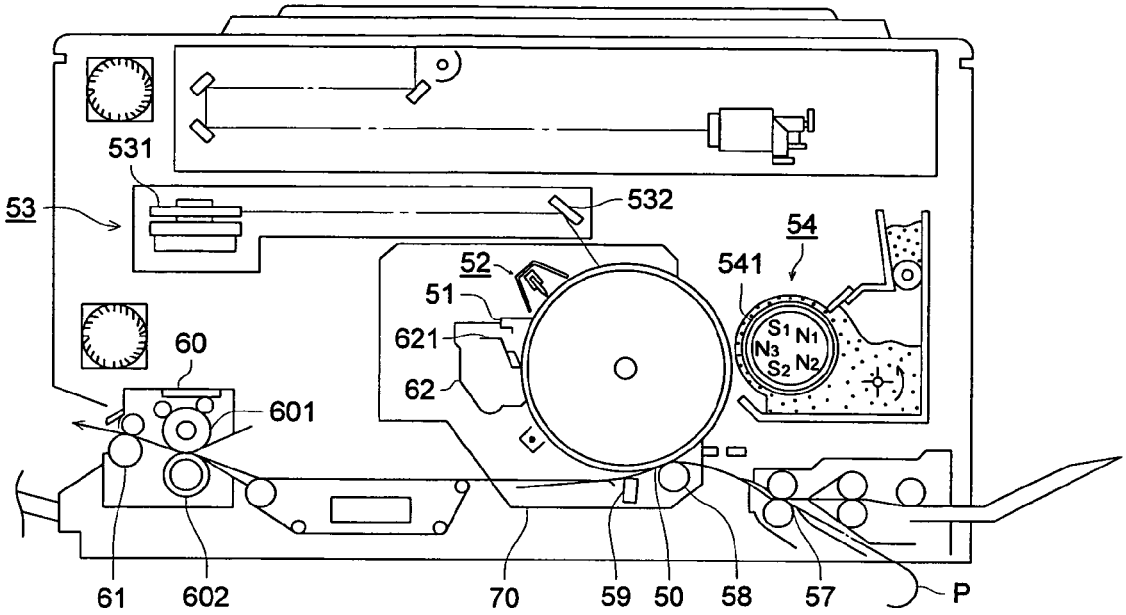
FIG. 1 is a cross sectional view for illustration showing an example of the structure of an image forming apparatus of the invention.

Firstly, preferable structures of the present invention to attain the above objects are described hereinafter.

A present invention involves a photoconductor for electrophotography wherein a photosensitive layer containing charge generation material is formed on a conductive substrate, and the charge generation material contains a substituted or unsubstituted gallium phthalocyanine dimer and a substituted or unsubstituted hydroxy gallium phthalocyanine and has distinctive diffraction peaks at least at the Bragg angles (2θ±0.2) of 7.5° and 28.3° in the Cu-Kα characteristic X-ray diffraction spectrum, preferably, has high diffraction peaks at least at the Bragg angles (2θ±0.2) of 7.5° and 28.3°.

By the photoconductor for electrophotography, stable image forming characteristics wherein excellent sensitivity characteristics and high stability of charged potential are obtained, and visible images which are free from image defects such as black streaks and black spots can be formed despite repeated use. Also, by using the photoconductor, it is possible that an image forming method, an image forming apparatus, and a process cartridge each capable of forming stably a visible image that is free from image defects such as black streaks and black spots.

Preferably, the charge generation material contains an unsubstituted gallium phthalocyanine dimer and an unsubstituted hydroxy gallium phthalocyanine.

In the above photoconductor for electrophotography, it is preferable that the charge generation material has distinctive peaks at the Bragg angles (2θ±0.2) of 7.5°, 9.9°, 12.5°, 16.3°, 18.6°, 25.1° and 28.3° in the Cu-Kα characteristic X-ray diffraction spectrum.

Furthermore, it is preferable that the gallium phthalocyanine dimer contained in the charge generation material be a μ-oxo-dimer.

In a photoconductor for electrophotography according to the present invention, the photosensitive layer can be a lamination type photosensitive layer which comprises a charge generation layer containing charge generation material, a charge transport layer laminated thereon, and a protective film as required. Further, a photosensitive layer may be structured in a single layer structure in which a charge generation material and a charge transport material are mixed.

A method of producing a photoconductor for electrophotography according to the present invention involves a process of forming a photosensitive layer by a means that includes a process of coating a dispersion in which the above-mentioned charge generation material has been dispersed and drying it.

An image forming method according to the present invention is characterized by the use of the above-mentioned photoconductor for electrophotography.

An image forming apparatus according to the present invention includes the above-mentioned photoconductor for electrophotography.

A process cartridge for forming images according to the present invention includes the above-mentioned photoconductor for electrophotography.

According to a photoconductor for electrophotography in accordance with the present invention, charge generation material included in a photosensitive layer contains a substituted or unsubstituted gallium phthalocyanine dimer and a substituted or unsubstituted hydroxy gallium phthalocyanine, and the charge generation material also has high diffraction peaks at least at the Bragg angles (2θ±0.2) of 7.5° and 28.3° in the Cu-Kα characteristic X-ray diffraction spectrum, thereby achieving high sensitivity, low memory characteristics and high stability of potential. As a result, the photoconductor for electrophotography makes it possible to stably form visible images that have no image defects, such as image blurring and black spots, after the photoconductor has been repetitively used.

The present invention uses a specific metal phthalocyanine compound as charge generation material, and a photoconductive photosensitive layer containing the charge generation material is formed on a conductive substrate, thereby making a photoconductor for electrophotography.

Charge generation material used in the present invention contains both a gallium phthalocyanine dimer and a hydroxy gallium phthalocyanine, and has high diffraction peaks at least at the Bragg angles (2θ±0.2) of 7.5° and 28.3° in the Cu-Kα characteristic X-ray diffraction spectrum. Herein, the "high diffraction peak" defines the peak having a relative peak value of 40 or more assuming that the maximum diffraction peak value is 100 in the diffraction spectrum.

Furthermore, it is preferable that the charge generation material has characteristic diffraction peaks at all of the Bragg angles (2θ±0.2) of 7.5°, 9.9°, 12.5°, 16.3°, 18.6°, 25.1° and 28.3° in the Cu-Kα characteristic X-ray diffraction spectrum. Herein, the "characteristic diffraction peak" defines the peak having a relative peak value of 20 or more assuming that the maximum diffraction peak is 100 in the diffraction spectrum. As the charge generation material, it may be preferable to contain an unsubstituted gallium phthalocyanine dimer and an unsubstituted hydroxy gallium phthalocyanine. In these gallium phthalocyanine dimmer and hydroxy gallium phthalocyanine, it may be possible to make their phthalocyanine nucleus to have a substituted group. As the substituted group, for example, a halogen atom, an alkyl group, or an alkoxy group, aryloxy group may be employed.

Hydroxy gallium phthalocyanine (monomer, and hereafter also referred to as "GaPhC monomer") and gallium phthalocyanine dimer (hereafter also referred to as "GaPhC dimer") contained in the charge generation material can be manufactured, for example, by the following method.

For example, in a high-boiling-point organic solvent such as 1-chloronaphthalene or quinoline, phthalonitrile or 1,3-diiminoisoindoline reacts with gallium chloride to form chlorogallium phthalocyanine, and then chlorogallium phthalocyanine is hydrolyzed, thereby obtaining a GaPhC monomer. Then, the GaPhC monomer is hot dried, for example, in a high-boiling-point organic solvent, thereby obtaining a μ-oxo-GaPhC dimer.

In the present invention, charge generation material which forms a photosensitive layer must contain both the GaPhC dimer and the GaPhC monomer, and the total amount of the GaPhC dimer and the GaPhC monomer is preferably 90 mol % or more of the entire charge generation material. Specifically, the most preferable charge generation material to be used is a mixture of the GaPhC dimer and the GaPhC monomer.

Charge generation material used in the present invention can be obtained by mixing pure GaPhC dimer material and pure GaPhC monomer material each of which has been individually synthesized. However, for example, it is possible to directly prepare a mixture of the GaPhC dimer and the GaPhC monomer by properly selecting synthesis conditions in the GaPhC dimer or GaPhC monomer producing process, or by properly changing the conditions during the synthesis process.

In the charge generation material according to the present invention, it is preferable that the GaPhC dimer content be 25 to 99 mol %, most preferably 30 to 98 mol %, and the GaPhC monomer content be 1 to 75 mol %, most preferably 2 to 70 mol %. The content ratio of the GaPhC dimmer for the GaPhC monomer may preferably be 35 mol % or more, more preferably, the mol ratio of the dimmer/the monomer may be 50/50 to 90/10. With these range, both of image characteristics and electric characteristics can be improved, especially, memory characteristics may be enhanced.

Using charge generation material which contains very few GaPhC dimers makes it difficult to produce a photosensitive layer having high stability of potential; whereas using charge generation material which contains too many GaPhC dimers results in producing a photosensitive layer having low sensitivity, thereby making it impossible to obtain excellent image forming characteristics.

Furthermore, if charge generation material contains GaPhC monomers and GaPhC dimmers in such ratio, a photosensitive layer having high sensitivity thereby making it possible to obtain excellent image forming characteristics and high stability of potential.

According to the present invention of a photoconductor for electrophotography, it is preferable that the photoconductor includes a cylindrical conductive substrate, and a photosensitive layer formed on the peripheral surface of the conductive substrate, wherein the photosensitive layer is a layer-upon-layer type photosensitive layer which includes a charge generation layer and a charge transport layer laminated thereon.

When the photosensitive layer is a layer-upon-layer type photosensitive layer, the sequential order of laminating the charge generation layer and the charge transport layer is determined according to various conditions. In one case, the charge generation layer is located in a lower layer near the conductive substrate, but in another case, the charge transport layer is located in the lower layer. Furthermore, it is possible to form the photosensitive layer by using a single photoconductive layer that contains charge generation material. In fact, in some cases as required, an appropriate intermediate layer is provided between the conductive substrate and the photosensitive layer, and furthermore, a surface layer, such as a protective layer, is provided on the surface of the photosensitive layer. Thus, the photoconductor for electrophotography is configured.

As stated above, a cylindrical metal conductive substrate, made of aluminum or stainless steel, is generally used as a conductive substrate, and a conducting layer is sometimes formed on the surface of the conductive substrate.

In the present invention, the above-mentioned charge generation material, binder resin, and a solvent are dispersed together with an additive used as required, thereby preparing a dispersion which is a composition for forming a charge generation layer. Then, by coating and drying the dispersion, it is possible to form a charge generation layer that contains the charge generation material, and the charge generation layer constitutes a photosensitive layer.

In a composition for forming the charge generation layer, with regard to the GaPhC dimer and GaPhC monomer that are charge generation material, those of them having a primary grain diameter of 0.01 to 0.5 μm may be preferable, further preferably, the primary grain diameter may be 0.5 μm or less, more preferably, 0.3 μm or less, especially preferably, 0.15 μm or less.

Binder resin which is a component of the composition for forming the charge generation layer is not intended to be limited to a specific type, and any resin that has been commonly used for this kinds of purposes can be used. Specific examples include: polyvinyl butyral resin, polyvinyl formal resin, polyvinyl acetal resin such as partially acetalized polyvinyl acetal resin which has been made by denaturing a part of butyral by formal or acetoacetal, polyamide resin, polyester resin, denatured ether polyester resin, polycarbonate resin, acrylic resin, polyvinyl chloride resin, polyvinylidene chloride resin, polystyrene resin, polyvinyl acetate resin, vinyl chloride-vinyl acetate copolymer, silicone resin, phenol resin, phenoxy resin, melamine resin, benzoguanamine resin, urea resin, polyurethane resin, poly-N-vinyl carbazole resin, polyvinyl anthracene resin, and polyvinyl pyrene resin. Among those, polyvinyl acetal resin, vinyl chloride-vinyl acetate copolymer, phenoxy resin and denatured ether polyester resin are especially preferable. Those resins can sufficiently disperse the above-mentioned charge generation material, thereby preventing pigment from aggregating and keeping the dispersion stable. Thus, using the dispersion as a coating solution will form a uniform film. As a result, excellent electrical characteristics can be obtained, thereby forming images with very few image quality defects. However, the binder resin is not intended to be limited to those resins, and any resin can be used as far as the resin can form a film in ordinary situations. A single binder resin or two or more resins can be used simultaneously. Furthermore, it is preferable that the compounding ratio of the charge generation material to the binder resin be between 5:1 and 1:2 by volume.

A solvent which is a component of the composition for forming the charge generation layer forms a liquid dispersing medium for a dispersion, and it is sufficient if it dissolves binder resin being used. Specific examples of commonly-used organic solvents include: methanol, ethanol, n-propanol, n-butanol, benzyl alcohol, methyl cellosolve, ethyl cellosolve, acetone, methyl ethyl ketone, cyclohexanone, chlorobenzene, methyl acetate, n-butyl acetate, dioxane, tetrahydrofuran, methylene chloride, and chloroform. A single solvent of such kind or a mixture of two or more of those solvents can be used.

By dispersing and stirring the above-mentioned charge generation material, binder resin, solvent, and additive together with an appropriate dispersion aid (dispersion medium), used as required, by means of an appropriate dispersing apparatus, it is possible to prepare a dispersion for the composition for forming the charge generation layer.

A specific dispersing method is not particularly limited, but, in fact, it is preferable that processes of dissolving binder resin in a solvent and dispersing the GaPhC monomer be conducted before the process of adding and dispersing the GaPhC dimer. By doing so, it is possible to highly efficiently disperse the entire charge generation material.

As a method to coat dispersions of composites for forming a charge generation layer, a coating method which has been known can be used, and a coating method through immersion is preferably used because a cylindrical conductive substrate is used actually.

When the photosensitive layer is of the layer upon layer type, a charge transport layer can be of the structure which has been known, and each of an intermediate layer and a surface layer can be of the structure which has been known.

A photoconductor for electrophotography is constructed in a way that a photosensitive layer containing charge generation substances is formed on the surface of a conductive substrate, as stated above, and an image forming apparatus is constructed when the photoconductor for electrophotography is mounted. The so-called process cartridge of a unification type can also be constructed by mounting the photoconductor for electrophotography integrally on the common support together with a constituent element for another image forming apparatus.

FIG. 1 shows a sectional view for illustration showing an example of the structure of an image forming apparatus of the invention.

In FIG. 1, the numeral 50 represents a cylindrical photoconductor for electrophotography, wherein the conductive substrate is provided to be driven for clockwise rotation under the condition that the conductive substrate is maintained at ground potential. The numeral 52 represents a charging unit constituting a charging unit which evenly charges an outer circumferential surface of photoconductor 50 by coronal discharge. Preceding charging by the charging unit 52, an exposure is given by neutralizing exposure device 51 employing light-emitting diode, for removing an influence of charging hysteresis by image forming process on the photoconductor.

Image-wise exposures are given by image-wise exposure unit 53 to the photoconductor 50 that is evenly charged electrically by the charging unit 52, based on image signals. The image-wise exposure unit 53 in the present example is one whose light source is an unillustrated laser diode, and light that passes through rotating polygon mirror 531 and $\phi\theta$ lens and is controlled in terms of optical path by reflection mirror 532 is made to scan on the outer circumferential surface of is controlled by the photoconductor 50, thus, an electrostatic latent image is formed.

The electrostatic latent image thus formed is then developed by a developing device. Specifically, developing unit 54 is arranged along an outer circumferential surface of the photoconductor 50, and the electrostatic latent image on the photoconductor 50 is developed by developer carrier 541 that rotates while holding the developer with its built-in magnet. Namely, on an outer circumferential surface of the developer carrier 541, the developer is regulated by a layer thickness regulating device to form, for example, a layer thickness of 100-600 μm which is conveyed to a developing area. Then, in the developing area, there is generated a state wherein, for example, superimposed voltage including D.C. bias voltage and A.C. bias voltage is impressed on a portion between the photoconductor 50 and the developer carrier 541, and developing is conducted under the condition that a developer layer is in contact with a surface of the photoconductor 50, or under the non-contact condition.

As a developer, there is used a two-component developer that is composed of, for example, toner and carrier. Toner to be used is one wherein external agents such as silica or titanium oxide are added to colored particles whose main material, for example, contains components such as coloring agents like carbon black, charge-controlling agents and low molecular weight polyolefin. Carrier to be used is one, for example, that is of a resin-dispersed type.

Transfer sheet P is fed to a transfer area via rotation of sheet feed roller 57 at timing for expected transfer, in synchronization with forming of a toner image on the photoconductor 50. Though a plain paper is typically used as a transfer sheet, a type of the sheet is not limited in particular, provided that a toner image can be transferred and fixed, and a base film composed of resins such as PET for an overhead projector can also be used.

In the transfer area, a toner image on the photoconductor 50 is transferred onto transfer sheet P, when transfer unit 58 having a transfer roller constituting a transfer device is brought into pressure contact with a circumferential surface of the photoconductor 50 in synchronization with a transfer timing, to press the transfer sheet P which has been fed.

The transfer sheet P which has passed through the transfer area is neutralized and is separated from a circumferential surface of the photoconductor 50 by neutralizing and separating unit 59, and is conveyed to fixing unit 60. In this fixing unit 60, the transfer sheet P is pressed between heat roller 601 and pressure roller 602 to be heated and pressed, and thereby, the transfer sheet P on which the toner image has been fixed is ejected out of the apparatus through sheet-ejection roller 61. After the transfer sheet P has passed through the transfer unit 58, the transfer unit 58 is separated from the circumferential surface of the photoconductor 50 to be ready for the subsequent transfer of a toner image.

On the other hand, on the photoconductor 50 from which the transfer sheet P has been separated, toner remaining on the photoconductor 50 is removed by blade 621 of cleaning unit 62 that is brought into pressure contact with the outer circumferential surface of the photoconductor 50, and then, the photoconductor 50 is neutralized by neutralizing exposure device 51, to be ready for the following image forming process including charging by charging unit 52.

In the aforesaid example, the photoconductor 50, charging unit 52, transfer unit 58, neutralizing and separating unit 59 and cleaning unit 62 are mounted on the common support to be integrated to form process cartridge 70, and this process cartridge 70 can be mounted on and can be dismounted from an image forming apparatus main body by an appropriate device.

In the invention, it is possible to construct a process cartridge for forming images by combining a plurality of functional elements selected properly from constituent elements of the image forming apparatus, and thereby to make a system wherein the process cartridge for image forming can be mounted on and dismounted from an image forming apparatus main body.

A process cartridge of an integrated type is one in the structure wherein one or a plurality of a charging unit, an image-wise exposure unit, a developing unit, a transfer unit, a separating unit and a cleaning unit are combined solidly with a photoconductor, to be mounted on and dismounted from the apparatus main body.

For example, by combining one or a plurality of a charging unit, an image-wise exposure unit, a developing unit, a transfer unit, a separating unit and a cleaning unit solidly together with the aforesaid photoconductor, or by combining at least one of a charging unit, a developing unit and a cleaning unit or a recycling member with the aforesaid photoconductor, it is possible to construct a process cartridge of an integrated type, and to make this process cartridge to be a single unit capable of being mounted on an image forming apparatus main body on a detachable basis, and thereby to generate the structure wherein the single unit can be mounted on a detachable basis via a guide means such as a rail provided on the apparatus main body.

Incidentally, as a process cartridge for image forming, there is known a separation type cartridge, in addition to the cartridge of an integrated type, and this separation type cartridge has combined plural elements out of a charging unit, an image-wise exposure unit, a developing unit, a transfer unit, a separating unit and a cleaning unit, and is constructed as an object separate from the photoconductor.

When an electrophotographic image forming apparatus is used as a copying machine or a printer in the image forming apparatus of the invention, image-wise exposure is conducted by irradiating the photoconductor with reflected light or transmitted light coming from a document, or by irradiating the photoconductor with light through a method wherein a document is read by a sensor to become a signal, and a laser beam scans in accordance with the signal, or a method to drive LED array, or a method to drive a liquid crystal shutter array.

Figure 2:
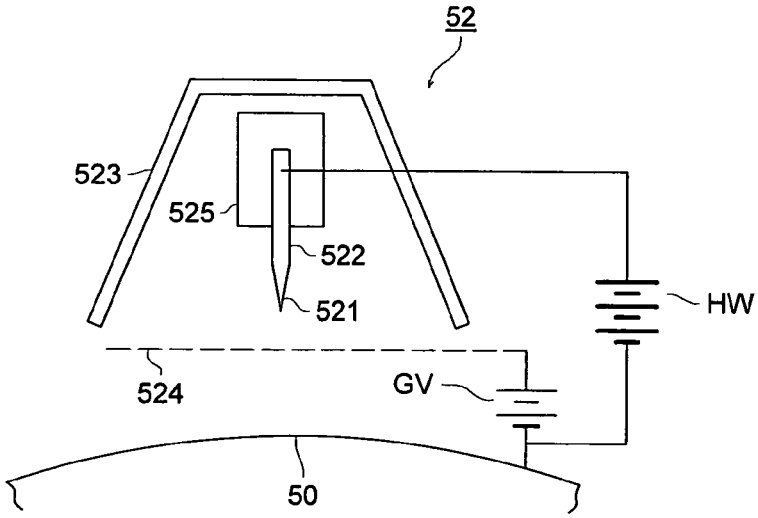
FIG. 2 is a cross sectional view showing details of a charging unit used for an image forming apparatus of the invention.

FIG. 2 is a cross-sectional view showing details of a charging unit used for an image forming apparatus of the invention. This charging unit 52 is composed of electrode body 522 on which needle-shaped electrodes 521 are shaped to stand in a line at prescribed intervals in the longitudinal direction of photoconductor 50, stabilizing plate 523 that stabilizes electric discharge from the needle-shaped electrodes 521 and grid electrode 524 provided between the needle-shaped electrodes 521 and the photoconductor 50.

The electrode body 522 is held mechanically by holding member 525, and is connected electrically with a conductive substrate of the photoconductor 50 through high-voltage power supply HV, while, the grid electrode 524 is electrically connected with a conductive substrate of the photoconductor 50 through grid power supply GV.

Figure 3:
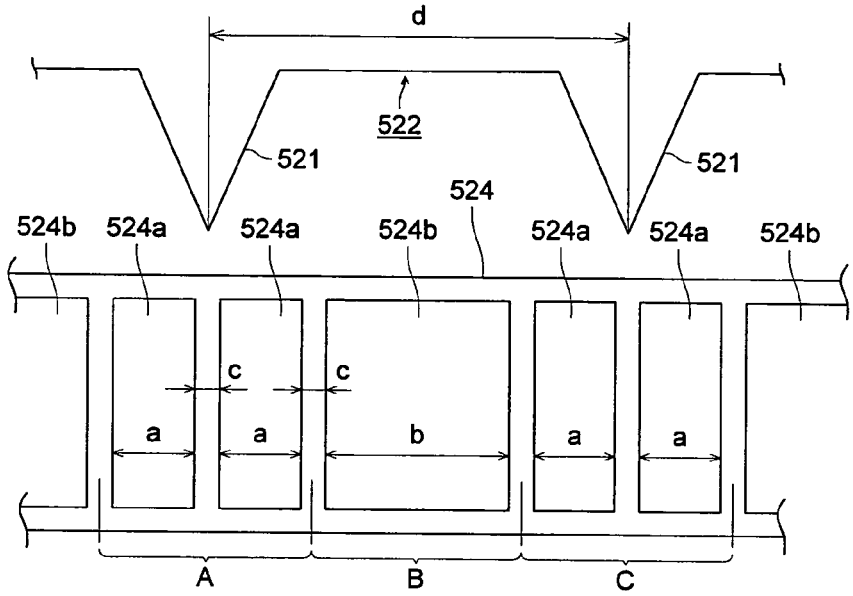
FIG. 3 is an illustration showing the structure about an electrode body in a charging unit and a grid electrode, wherein the lateral direction of the structure is represented by the longitudinal direction of the photoconductor.

FIG. 3 is a illustration wherein the structure about the electrode body 522 and the grid electrode 524 is shown under the condition that the lateral direction of the structure is represented by the longitudinal direction of the photoconductor 50. A side view of the electrode body 522 that is viewed from the left side in FIG. 2 is shown on FIG. 3, and a top view of the grid electrode 524 viewed from the top in FIG. 2 is shown in FIG. 3, for convenience' sake in explanation.

With regard to the electrode body 522, after a piece of metal plate has been subjected to cutting processing, triangle-shaped electrodes 521 in large quantities each being formed to protrude from each flat edge of the metal plate are arranged in the longitudinal direction of the photoconductor 50 at intervals d, and a space between adjoining needle-shaped electrodes remains unchanged to be a flat edge representing a non-electrode section.

On the other hand, the grid electrode 524 is one wherein a strip-shaped member which is obtained when apertures are formed on a material of electrode plate in the longitudinal direction of the photoconductor 50, and remains between adjoining apertures, functions as a grid electrode portion. Specifically, first apertures 524*a* in quantity of two each having a small crosswise dimension a and second aperture 524*b* in quantity of one having a large crosswise dimension b are formed to be arranged successively in the longitudinal direction of the photoconductor 50, and adjoining two first apertures 524*a* are arranged in an area corresponding to an oblique side portion of needle-shaped electrodes 521, and grid electrode section having crosswise dimension c between both of them is made to be in the state to face a tip of the needle-shaped electrode 521, while, second aperture 524*b* is arranged in an area corresponding to the non-electrode section, and a grid electrode having crosswise dimension c between the second aperture 524*b* and the first aperture 524*a* is made to be in the state to face the base section of the needle-shaped electrode 521. Therefore, two apertures 524*a* and one aperture 524*b* located between the aforesaid two are made to be in the state to be arranged to change periodically in synchronization with interval d of needle-shaped electrode 521.

In the grid electrode 524, width a of the first aperture 524*a* is set to 0.4 mm, width b of the second aperture 524*b* is set to 0.9 mm, width c of grid electrode is set to 0.1 mm, and interval (dimension of non-electrode section) d of the needle-shaped electrode 521 is set to 2.0 mm. In the grid electrode 524, therefore, if an aperture rate is represented by a ratio of an area including apertures 524*a* and 524*b* to an area of the total grid, an aperture rate on the area portion A fading the needle-shaped electrode 521 including an oblique side portion is about 80% and an aperture rate on the area portion B facing the interval portion between needle-shaped electrodes 521 is about 90%.

In a charging unit having the structure of this kind, it is preferable that voltage of high-voltage power supply HV is made to be, for example, −5--8 kV, and voltage of grid power supply is made to be, for example, −500--1000 (V).

Incidentally, it is also possible to provide a large number of needle-shaped electrodes 521 manufactured separately, by arranging them on a one-dimensional basis, in place of the electrode body 522, and thereby to constitute by connecting electrically each needle-shaped electrode 521.

The image forming apparatus of the invention is generally applicable to electrophotographic apparatuses such as electrophotographic copying machines, laser printers, LED printers and liquid crystal shutter type printers, and it can further be applied widely to apparatuses such as display in which electrophotographic technology is applied, recording, short-run printing, plate-making and facsimile machines.

EXAMPLE

Hereafter, an embodiment of the present invention will be described, but the present invention is not intended to be limited to the embodiment. Hereafter, the "part" means mass part, and the "X-ray diffraction spectrum" means a Cu-Kα characteristic X-ray diffraction spectrum.

Synthesis Example 1

Synthesis of μ-Oxo-gallium Phthalocyanine Dimer (1) Synthesis of Chlorogallium Phthalocyanine 177.2 g of phthalonitrile, 820 ml of 1-chloronaphthalene and 50.0 g of gallium chloride were put in a 1000-ml four-neck glass flask that comprises necessary instruments such as a mixer, calcium chloride tube, etc., and were stirred for 10 hours under reflux. After that, refluxing was stopped, the mixture was cooled down to nearly 200° C. and filtered in a heated state, and then sprinkle cleaning was conducted by using 3,500 ml of heated dimethyl formamide and 3,000 ml of dimethyl formamide. The obtained wet cake was dispersed in 800 ml of dimethyl formamide, stirred under reflux for 5 hours, and filtered in a heated state. Subsequently, sprinkle cleaning was conducted by using 2,500 ml of heated dimethyl formamide and 2,000 ml of dimethyl formamide, and methanol was substituted for dimethyl formamide and dried. Thus, 125.0 g (yield 73.5%) of blue, solid chlorogallium phthalocyanine was obtained.

(2) Synthesis of Type-A Dimer 10.0 g of chlorogallium phthalocyanine, obtained as stated above, was gradually dissolved into 300 g of concentrated sulphuric acid at temperatures between 0 to 5° C., and stirred for an hour in those temperatures. Then, the solution was filtered by a glass filter to remove undissolved substances, and the filtered solution was stirred and poured into 1,500 ml of ice water while keeping the temperature not more than 5° C., and then stirred for 2 more hours. After that, the solution was filtered, washed with water, and then dispersed in 1,500 ml of deionized water and filtered. After washed with water, the wet cake was dispersed in 600 ml of 4% aqua-ammonia, and stirred for 68 hours under reflux, and filtered. The obtained wet cake was sufficiently cleaned by deionized water, dried under reduced pressure at 50° C., and ground, thereby 8.72 g (yield 89.8%) of blue solid material was obtained.

Next, 7.7 g of the obtained blue solid material was added to 160 ml of quinoline, and stirred at temperatures between 190 and 200° C. By using a previously attached ester tube, the solution was stirred for 3 hours under reflux while generated water was being removed from the reaction system. Then, the solution was filtered in a heated state, sprinkle cleaning was conducted by using DMF, and methanol was substituted for DMF in the cake, and then the cake was dried and ground. Thus, 7.1 g (yield 93.6%) of μ-oxo-gallium phthalocyanine dimer that contains type-A crystal modification was obtained.

(3) Synthesis of Amorphous Dimer 70 g of type-A μ-oxo-gallium phthalocyanine dimer, obtained as stated above, was put as a Bessel wall member in the sand grinder that uses silicon carbide, and dry grinding was performed for 20 hours by using zirconia ceramics of a grain diameter of 3 mm as grinding media. The dimer was converted into an amorphous dimer during this process. After that, the grinding media were separated, and 15 g of blue, solid amorphous μ-oxo-gallium phthalocyanine dimer was obtained.

(4) Synthesis of μ-Oxo-gallium Phthalocyanine Dimer 300 ml of dimethyl formamide was added to 10 g of amorphous μ-oxo-gallium phthalocyanine dimer, obtained as stated above, and stirred and dispersed for 15 hours at room temperature. Then, solid matter was filtered and separated from the dispersing element, and ethyl acetate was substituted for dimethyl formamide, and then the solid matter was dried under reduced pressure. Thus, 7.9 g of blue, solid μ-oxo-gallium phthalocyanine dimer was obtained.

This material had characteristic diffraction peaks at the Bragg angles (2θ±0.2°) of 7.5°, 9.9°, 12.5°, 16.3°, 18.6°, 25.1° and 28.3° in the X-ray diffraction spectrum.

Any of the following can be used as a phthalocyanine dimer compound detection method: the matrix-assisted laser desorption ionization time-of-flight type mass spectrometry (hereafter, referred to as "MSLDI-TOF-MS method", or simply "TOF-MS method" for abbreviation), field emission mass spectrometry, high-speed atom impact mass spectrometry, or the electron impact ionization mass spectrometry.

When the MALDI-TOF-MS method is used, any forms of specimens can be measured such as the form of fine powder, the form of specimen in which only fine powder has been dispersed or dissolved in an organic solvent and then dried by an appropriate method, or the form of specimen in which fine powder and various resin binders have been dispersed or dissolved in an organic solvent and then dried by an appropriate method; and the specimen can be quantified by adding a matrix compound.

By means of those measuring methods, it was verified that the μ-oxo-gallium phthalocyanine dimer obtained as stated above was 100% pure material.

Synthesis Example 2

Synthesis of Hydroxy Gallium Phthalocyanine (1)

10 parts of 3 gallium chloride and 29.1 parts of orthophthalonitrile were added to 100 ml of α-chloronaphthalene, and reacted under the nitrogen gas stream at 200° C. for 24 hours, and then produced chlorogallium phthalocyanine crystal was filtered and separated. This wet cake was dispersed in 100 ml of dimethyl formamide, stirred at 150° C. for 30 minutes, and filtered and separated. Then, the cake was sufficiently cleaned by methanol and dried, thereby obtaining 28.9 parts (82.5%) of chlorogallium phthalocyanine crystal. 2 parts of obtained chlorogallium phthalocyanine were dissolved in 50 parts of concentrated sulphuric acid, stirred for 2 hours, and then dripped into a mixture of 75 ml ice cold distilled water, 75 ml of concentrated aqua-ammonia and 450 ml of dichloromethane, thereby precipitating crystal. The precipitated crystal was sufficiently cleaned with distilled water and dried, thereby obtaining 1.8 parts of hydroxy gallium phthalocyanine crystal. This crystal had characteristic diffraction peaks at the Bragg angles (2θ±0.2°) of 7.0°, 13.4°, 16.6°, 26.0° and 26.7° in the X-ray diffraction spectrum.

Synthesis Example 3

Synthesis of Hydroxy Gallium Phthalocyanine (2)

One part of hydroxy gallium phthalocyanine (1) crystal, obtained by the above-mentioned synthesis example 2, was milled together with 15 parts of N, N-dimethyl formamide and 30 parts of glass beads having a diameter of 1 mm for 24 hours. Then, crystal was separated, cleaned by n-butyl acetate and dried, thereby obtaining 0.9 parts of hydroxy gallium phthalocyanine (2) crystal. This crystal had characteristic diffraction peaks at the Bragg angles (2θ±0.2°) of 7.5°, 9.9°, 12.5°, 16.3°, 18.6°, 25.1° and 28.3° in the X-ray diffraction spectrum, and among them, the peaks at Bragg angles of 7.5° and 28.3° were high diffraction peaks.

Preparation of Charge Generation Material

[Charge Generation Material a]

The μ-oxo-gallium phthalocyanine dimer, obtained by the above-mentioned synthesis example 1, was directly used as charge generation material a. Charge generation material a includes 100 mol % of GaPhC dimer and 0 mol % of GaPhC monomer.

[Charge Generation Material b]

Hydroxy gallium phthalocyanine (2), obtained by the above-mentioned synthesis example 3, was directly used as charge generation material b. Charge generation material b includes 0 mol % of GaPhC dimer and 100 mol % of GaPhC monomer.

[Charge Generation Material c]

72 milli mol of hydroxy gallium phthalocyanine (2), obtained by the above-mentioned synthesis example 3, was added to 50 ml of N, N-dimethyl formamide and stirred at room temperature for 2 hours and dispersed, then, 28 milli mol of μ-oxo-gallium phthalocyanine dimer, obtained by the above-mentioned synthesis example 1, was gradually added while dispersing it, and furthermore, stirred and dispersed for 3 hours. This mixture was filtered and separated, ethyl acetate was substituted for N, N-dimethyl formamide, and then dried under reduced pressure, thereby obtaining a blue, solid, mixture containing the GaPhC dimer. This is used as charge generation material c. Charge generation material c includes 28 mol % of GaPhC dimer and 72 mol % of GaPhC monomer.

[Charge Generation Material d]

In the same manner as charge generation material c, but by using 67 milli mol of hydroxy gallium phthalocyanine (2), obtained by the above-mentioned synthesis example 3, and 33 milli mol of μ-oxo-gallium phthalocyanine dimer, obtained by the above-mentioned synthesis example 1, a blue, solid, GaPhC dimer contained mixture which contains 33 mol % of GaPhC dimer and 67 mol % of GaPhC monomer was obtained. This is used as charge generation material d.

[Charge Generation Material e]

In the same manner as charge generation material c, a blue, but by using 50 milli mol of hydroxy gallium phthalocyanine (2), obtained by the above-mentioned synthesis example 3, and 50 milli mol of μ-oxo-gallium phthalocyanine dimer, obtained by the above-mentioned synthesis example 1, a blue, solid, GaPhC dimer contained mixture which contains 50 mol % of GaPhC dimer and 50 mol % of GaPhC monomer was obtained. This is used as charge generation material e.

[Charge Generation Material f]

In the same manner as charge generation material c, but by using 5 milli mol of hydroxy gallium phthalocyanine (2), obtained by the above-mentioned synthesis example 3, and 95 milli mol of μ-oxo-gallium phthalocyanine dimer, obtained by the above-mentioned synthesis example 1, a blue, solid, GaPhC dimer contained mixture which contains 95 mol % of GaPhC dimer and 5 mol % of GaPhC monomer was obtained. This is used as charge generation material f.

[Charge Generation Material g]

In the same manner as charge generation material c, but by using 2 milli mol of hydroxy gallium phthalocyanine (2), obtained by the above-mentioned synthesis example 3, and 98 milli mol of μ-oxo-gallium phthalocyanine dimer, obtained by the above-mentioned synthesis example 1, a blue, solid, GaPhC dimer contained mixture which contains 98 mol % of GaPhC dimer and 2 mol % of GaPhC monomer was obtained. This is used as charge generation material g.

[Charge Generation Material h]

Hydroxy gallium phthalocyanine (1), obtained by the above-mentioned synthesis example 2, was directly used as charge generation material h. Charge generation material h contains 0 mol % of GaPhC dimer and 100 mol % of GaPhC monomer, and X-ray diffraction spectrum thereof does not satisfy the conditions required by the present invention.

The above charge generation materials a-h were analyzed by the MALDI-TOF-MS method, and analytical curves were created to be used for determining the GaPhC dimer and GaPhC monomer contents. Moreover, GaPhC dimer and GaPhC monomer compositions did not change under the above-mentioned dispersing and stirring conditions.

Figure 4:
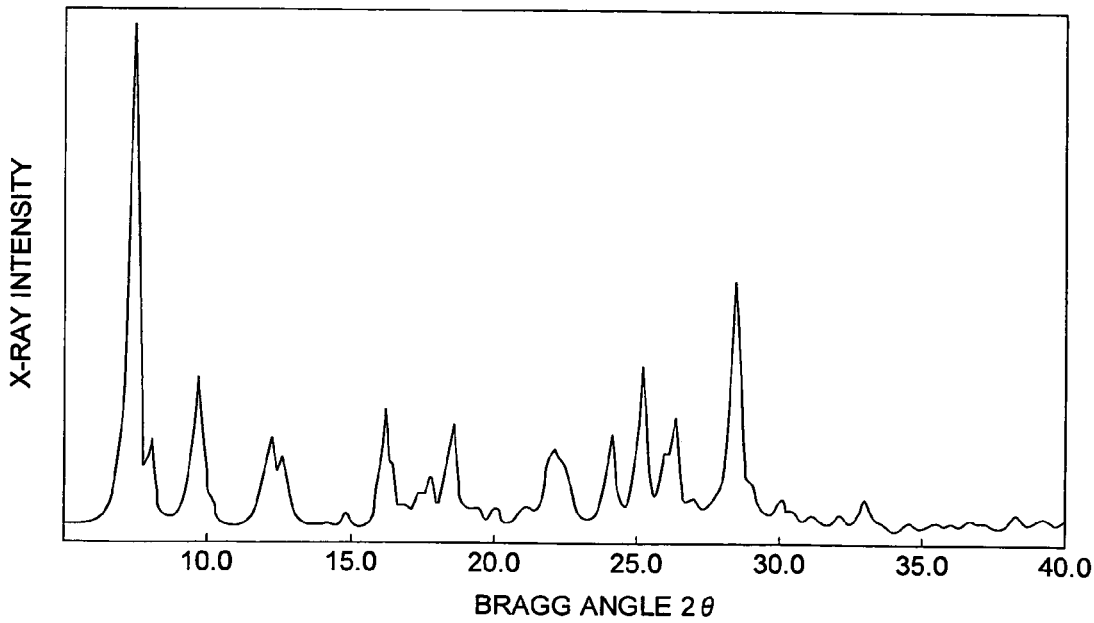
FIG. 4 shows a diffraction spectrum for X-rays about charge generating substances c.

FIG. 4 is a X-ray diffraction spectrum of the above-mentioned charge generation material c, and the same X-ray diffraction spectrums were obtained with regard to charge generation materials d-g.

Furthermore, a charge generation layer containing the charge generation material was separated from the photoconductor for electrophotography which had been produced by using the above-mentioned charge generation material according to procedures, described later, and then the charge generation material was recovered and analyzed by the above-mentioned method. The result proved that the GaPhC dimer and GaPhC monomer contents did not change in any of those charge generation materials, and their X-ray diffraction spectrums had the same peak value.

<Production of Photoconductor 1>

(1) Forming the Intermediate Layer

A composition (UCL-1) for forming the intermediate layer was coated on the cylindrical aluminum conductive substrate by the immersion method, heated and dried at 150° C. for 10 minutes, thereby forming a 0.2 μm thick intermediate layer.

The composition (UCL-1) for forming the intermediate layer comprises 10 parts of zirconium compound (product name: ORGACHICS ZC540, made by Matsumoto Chemical Industry Co., Ltd.), one part of silane compound (product name: A1110, made by Japan Yunker), 40 parts of isopropanol, and 20 parts of butanol.

(2) Forming the Charge Generation Layer

One part of the above-mentioned charge generation material a, one part of polyvinyl butyral (product name: ESRECK BM-S, made by Sekisui Chemical Co., Ltd.) which is binder resin, 100 parts of n-butyl acetate which is a solvent were dispersed together with glass beads for one hour by a paint shaker, thereby preparing a dispersion (CGL-a) for forming the charge generation layer.

The dispersion (CGL-a) for forming the charge generation layer was coated on the above-mentioned intermediate layer by the immersion method, heated and dried at 100° C. for 10 minutes, thereby forming an approximately 0.2 μm thick charge generation layer.

(3) Forming the Charge Transport Layer 2 parts of N,N-bis(3,4-dimethylphenyl)biphenyl-4-amine, 2 parts of N,N'-diphenyl-N,N'-bis(3-methylphenyl )-1,1'-biphenyl-4,4'-diamine, 6 parts of bisphenol type-Z polycarbonate (viscosity average molecular weight 40,000), 80 parts of tetrahydrofuran and 0.2 parts of 2,6-di-t-butyl-4-methyl phenol were mixed, thereby preparing a dispersion (CTL-1) for forming charge transport layer.

The dispersion (CTL-1) for forming charge transport layer was coated on the above-mentioned charge generation layer by the immersion method, heated and dried at 120° C. for an hour, thereby forming a 20 μm thick charge transport layer. Thus, photoconductor 1 was manufactured.

<Production of Photoconductors 2-8>

In the above-mentioned photoconductor 1 producing procedures, dispersions (CGL-b)-(CGL-h) for forming the charge generation layer were prepared by using charge generation materials b-h, instead of using charge generation material a, and charge generation layers were formed by using each of those materials. Thus, photoconductors 2-8 were manufactured.

Among the above photoconductors 1-8, photoconductors 3-7 are in accordance with the present invention, and photoconductors 1, 2 and 8 are photoconductors for comparison.

[Stability of Dispersion for Forming the Charge Generation Layer]

7 ml of each dispersion (CGL-a) to (CGL-h) for forming the charge generation layer used for producing the above-mentioned photoconductors 1-8 was individually put in a test tube, and stored for a week in the confined state at normal temperature and under normal pressure, and sediment of charge generation material grains were observed. As a result, in a dispersion (CGL-a) for forming the charge generation layer in which charge generation material a containing only GaPhC dimer, most of charge generation material a settled leaving a clear supernatant. On the other hand, in dispersions (CGL-b) to (CGL-h) for forming the charge generation layer that use charge generation materials b-h, almost no clear supernatant part was left.

Based on the above, it was verified that charge generation material a containing only GaPhC dimer has low dispersion stability, and in the case of other charge generation materials b-h, that is, the GaPhC monomer, or a mixture of the GaPhC dimer and 2 mol % or more of GaPhC monomer, dispersion stability is high.

[Evaluation of Image Forming Performance of Photoconductors 1-8]

The above-mentioned photoconductors 1-8 were individually loaded into a modified machine of digital copier "Konica7050", which is basically configured as shown in FIG. 1 and conducts image forming operations by means of corona discharge, laser exposure, reversal development, electrostatic image transfer, separation, and an image forming process by the cleaning blade, and image forming tests were carried out.

Conditions of each part of the image forming apparatus was as follows:

(1) A developer for digital copier "Konica7050" was directly used as a developer. (2) Normal process conditions were specified for the copier's process conditions. (3) A charging device shown in FIG. 2 and FIG. 3 was used for generating a charge, and the initial charge potential was set to −750 V. (4) The amount of exposure was specified so that the exposure section's potential is −50 V. (5) With regard to development conditions, a development sleeve having a diameter of 40 mm was situated so that the width (Dsd) of the clearance of the development area between the photoconductor and the development sleeve was 550 μm, and direct current bias was −550 V, and the developer layer was 700 μm thick according to the edge cutting method. (6) Transfer conditions were such that the transfer dummy current value was 45 μA due to the transfer pole according to the corona discharge method. (7) Cleaning was conducted by means of the polyurethane cleaning blade which has been contact-pressed by a linear pressure of 20 N/m.

Image forming tests were carried out as follows:

In an environment where the temperature was 24° C. and relative humidity was 60%, an A4-size image was used as an original image that has a striped pattern of 2-mm wide white lines and black lines arranged alternatively and the image's 2-cm wide tip area and the subsequent area were divided into four equal parts: text image area with a pixel rate of 7%, dot halftone image area with image density of 0.7, white solid image area, and black solid image area. A4-size ordinary paper was used as transfer paper, and image forming speed was 50 sheets per minute. Under such conditions, continuous copying operations that are to continuously form reproduced images 10,000 times were conducted multiple times while a one-hour recess was repetitively provided between those continuous copying operations.

Moreover, before starting to form the first reproduced image in each round of continuous copying operations, setting powder was coated on the photoconductor and the cleaning blade in order to smoothly operate the photoconductor and the cleaning blade, and the photoconductor was rotated for one minute.

Then, with respect to the reproduced image of the 10,000-th sheet during continuous copying operations, the image conditions of each image-area were evaluated for the stability of potential, memory characteristics, presence or absence of image blurring or black spots. Results are shown in Table 1. Moreover, in the Table, "D/M" indicates the content ratio of the GaPhC dimer and the GaPhC monomer by mol %. The "(i)" in the "Bragg angle" column indicates that distinctive peaks appear at the Bragg angles of 7.5°, 9.9°, 12.5°, 16.3°, 18.6°, 25.1° and 28.3°, and the "(ii)" indicates that distinctive peaks appear at the Bragg angles of 7.0°, 13.4°, 16.6°, 26.0° and 26.7°.

Evaluation reference for each evaluation item is as follows:

(1) Stability of Potential (Initial Potential Shift $\Delta V_{1.2}$)

In the second round of continuous copying operations, the charge potential value of the photoconductor's unexposed section (white solid image part) in the first image forming process and the charge potential value of the same section in the subsequent second image forming process were measured at the development position, and the difference between those potential values was obtained as an absolute value (unit: V). The value of the initial potential shift $\Delta V_{1.2}$ indicates that as the value decreases, the stability of charge potential increases.

(2) Memory Characteristics

With regard to 10,000 visible images formed by the first round of continuous copying operations, the number of visible images on which an image memory phenomenon, specifically, a phenomenon in which a black, solid afterimage is formed on a halftone image has occurred. A: the number of visible images that has an image memory phenomenon is 0, and excellent condition. B: the number of visible images that has an image memory phenomenon is 1 to 4, and practically no problem. C: the number of visible images that has an image memory phenomenon is 5 or more, and this is a practical problem.

(3) Image Blurring

In the first round of continuous copying operations, reproduced text images of the first visible image and the 10,000-th visible image were visually inspected for the presence or absence of image blurring. A: There was no image blurring, and excellent condition. B: There is image blurring, but practically no problem. C: There is image blurring and text smear.

(4) Black Spot

After the first round of continuous copying operations had finished, a white solid image was continuously copied on 100 A4-size sheets, and the obtained visible images were inspected under a microscope with a video printer for a "black spot" that is a black dot having a major diameter of 0.4 mm or more, and the frequency of appearance was evaluated. A: the number of black spots was 3 or less with regard to all of the reproduced images, and excellent condition. B: 4 or more black spots appeared on some reproduced images, but the number of black spots was 10 or less with regard to all of the reproduced images, and practically no problem. C: 11 or more black spots appeared on some reproduced images.

TABLE 1

| Photoconductor | Embodiment/ Comparison example | Charge generation material | D/M | Bragg angle | Stability of potential $\Delta V_{1.2}$ (V) | Memory characteristics | Image blurring | Black spot | Total evaluation |
|---|---|---|---|---|---|---|---|---|---|
| 1 | Comparison example | a | 100/0 | — | 8 | A | C | C | C |
| 2 | Comparison example | b | 0/100 | — | 17 | C | B | A | C |
| 3 | Embodiment | c | 28/72 | (i) | 8 | B | A | A | B |
| 4 | Embodiment | d | 33/67 | (i) | 5 | A | A | A | A |
| 5 | Embodiment | e | 50/50 | (i) | 5 | A | A | A | A |
| 6 | Embodiment | f | 95/5 | (i) | 5 | A | A | A | A |
| 7 | Embodiment | g | 98/2 | (i) | 7 | A | A | B | B |
| 8 | Comparison example | h | — | (ii) | 20 | C | C | C | C |

(i) 7.5°, 9.9°, 12.5°, 16.3°, 18.6°, 25.1°, 28.3° (see FIG. 4)
(ii) 7.0°, 13.4°, 16.6°, 26.0°, 26.7°

<Production of Photoconductor 9>

(1) Forming the Conducting Layer

A dispersion (CPL-1) for forming the conducting layer was coated on the cylindrical aluminum conductive substrate by the immersion method, and heat-cured at 140° C. for 30 minutes, thereby forming a 15 μm thick conducting layer.

The dispersion (CPL-1) for forming the conducting layer comprises 10 parts of tin oxide coated titanium oxide (conducting pigment), 10 parts of titanium oxide (resistance control pigment), 10 parts of phenol resin (binder resin), 0.001 parts of silicone oil (leveling agent), and 20 parts of mixed solvent containing methanol and methyl cellosolve by weight ratio of 1:1.

(2) Forming the Intermediate Layer

A dispersion (UCL-2) for forming the intermediate layer was coated on the above-mentioned conducting layer by the immersion method, heated and dried at 100° C. for 10 minutes, thereby forming a 0.5 μm thick intermediate layer.

The dispersion (UCL-2) for forming the intermediate layer comprises 3 parts of N-methoxy methylated nylon, 3 parts of copolymerized nylon, 65 parts of methanol, and 30 parts of n-butanol.

(3) Forming the Charge Generation Layer

One part of the above-mentioned charge generation material a, one part of polyvinyl butyral (product name: ESRECK BM-S, made by Sekisui Chemical Co., Ltd.) which is binder resin, 100 parts of n-butyl acetate which is a solvent were dispersed together with glass beads for one hour by a paint shaker, thereby preparing a dispersion (CGL-a) for forming the charge generation layer.

The dispersion (CGL-a) for forming the charge generation layer was coated on the above-mentioned intermediate layer by the immersion method, heated and dried at 100° C. for 10 minutes, thereby forming approximately 0.2 μm thick charge generation layer.

(4) Forming the Charge Transport Layer

A dispersion (CTL-2) for forming charge transport layer which comprises 10 parts of styryl compound indicated by the following constitutional formula (1), 10 parts of bisphenol type-Z polycarbonate (viscosity average molecular weight 20,000), 20 parts of dichloromethane, and 60 parts of monochlorbenzene was coated on the above-mentioned charge generation layer by the immersion method, and heated and dried at 150° C. for one hour, thereby forming a 20 μm thick charge layer.

Constitutional formula (1)

[Chemical formula 1]

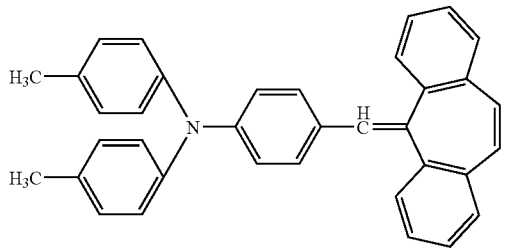

(5) Forming the Protective Layer 20 parts of antimony doped tin oxide fine grain which has been surface treated by a compound indicated by the following constitutional formula (2) with a processing volume of 7%, 30 parts of antimony doped tin oxide fine grain which has been surface treated by methyl hydrogen silicone oil (product name: KF-99, made by Shinetsu Silicone) with a processing volume of 25%, 18 parts of UV curing acrylic resin (product name: BISCOAT #295, made by Osaka Organic Chemical Industry Ltd.) indicated by the following constitutional formula (3), one part of 2-methyl thioxanthone (polymerization start agent), and 150 parts of ethanol were mixed, and dispersed by the sandmill for 66 hours, and then. 20 parts of polytetrafluoroethylene fine grain (average grain diameter of 0.18 μm) were added to it and dispersed, thereby preparing a composition (OCL-1) for forming the protective film.

The composition (OCL-1) for forming the protective film was coated on the above-mentioned charge transport layer by the immersion method, and cured by a high-pressure mercury vapor lamp with light intensity of 320 mW/cm$^2$ for 30 seconds, and then hot-air dried at 120° C. for 2 hours, thereby forming a 4 μm thick protective layer. Thus, photoconductor 9 was manufactured.

Constitutional formula (2)

[Chemical formula 2]

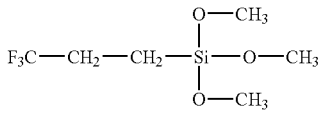

Constitutional formula (3)

[Chemical formula 3]

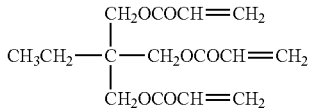

<Production of Photoconductors 10-12>

In the same manner as photoconductor 9, but by using charge generation materials b, e and h instead of using charge generation material a which was used for forming a charge generation layer for the above-mentioned photoconductor 9, dispersions (CGL-b), (CGL-e) and (CGL-h) for forming the charge generation layer were prepared. Then, in the same manner as stated above, but by using the dispersions (CGL-b), (CGL-e) and (CGL-h), photoconductors 10-12 were manufactured.

In photoconductors 9-12, photoconductors 9, 10 and 12 are photoconductors for comparison.

Visible images formed by using photoconductors 9-12 were individually evaluated for items other than the stability of potential in the same manner as photoconductors 1-8 by means of a modified machine of the image forming apparatus "laser shot 4000" (made by Hewlett-Packard Co.) that comprises the roller electrification, laser exposure, reversal development, and cleaning-less processes as an evaluation machine. Table 2 shows the results.

TABLE 2

| Photoconductor | Embodiment/ Comparison example | Charge generation material | D/M | Bragg angle | Memory characteristics | Image blurring | Black spot | Total evaluation |
|---|---|---|---|---|---|---|---|---|
| 9 | Comparison example | a | 100/0 | — | A | C | C | C |
| 10 | Comparison example | b | 0/100 | — | C | B | A | C |
| 11 | Embodiment | e | 50/50 | (i) | A | A | A | A |
| 12 | Comparison example | h | — | (ii) | C | C | C | C |

(i) 7.5°, 9.9°, 12.5°, 16.3°, 18.6°, 25.1°, 28.3° (see FIG. 4)
(ii) 7.0°, 13.4°, 16.6°, 26.0°, 26.7°

As the results in Table 1 and Table 2 clearly show, according to charge generation material which contains both the GaPhC monomer and the GaPhC dimer, and has high diffraction peaks at the Bragg angles (2θ±0.2) of 7.5° and 28.3° in the X-ray diffraction spectrum, and also has characteristic diffraction peaks at the Bragg angles (2θ±0.2°) of 9.9°, 12.5°, 16.3°, 18.6° and 25.1°, it is understood that the charge generation material is dispersed, and a dispersion for forming a charge generation layer that contains binder resin and a solvent is in highly stable dispersing condition, and therefore, it is possible to form a photoconductor for electrophotography having excellent electrophotography performance.

Specifically, dispersion stability tests for a dispersion (CGL-c) for forming the charge generation layer with regard to charge generation material c verify that dispersion stability is sufficiently high if the GaPhC monomer content is 2 mol % or more.

The above-mentioned results were obtained because the GaPhC monomer which contains a polarity group in the molecule thereof is contained in the charge generation material, and the GaPhC monomer acts as a dispersing agent, and therefore, the entire charge generation material is well dispersed with regard to a dispersing medium including a solvent, thereby the dispersion for forming the charge generation layer has excellent storage stability. Furthermore, because the GaPhC dimer that does not contain a polarity group is included, a photosensitive layer with highly stable potential and high sensitivity can be formed. As a result, according to a photoconductor for electrophotography containing the photosensitive layer, sensitivity is excellent and stable even after images have been continuously formed multiple times.

That is, in the charge generation material according to the present invention, because the GaPhC dimer and the GaPhC monomer coexist, defects that often appear when the GaPhC monomer is solely used do not appear and high dispersion property and dispersion stability are achieved, and electrophotography performance can be improved. As a result, it is possible to form excellent visible images free of image defects, such as black spots, as well as free of image blurring. Although the mechanism that enables such effects has not been elucidated, it is considered that the GaPhC monomer grain has an effect on the GaPhC dimer surface, but the monomer grain having excellent dispersion property seems to prevent the dimer grain from reaggregating.

What is claimed is:

1. A photoconductor for electrophotography, comprising:

a conductive substrate;

a photosensitive layer containing a charge generation material, the photosensitive layer formed on the conductive substrate, wherein the charge generation material contains a mixed compound of a substituted or unsubstituted μ-oxo-gallium phthalocyanine dimer and a substituted or unsubstituted hydroxy gallium phthalocyanine and the mixed compound has distinctive diffraction peaks at the Bragg angles (2θ±0.2) of 7.5° and 28.3° in a Cu-Kα characteristic X-ray diffraction spectrum, wherein the charge generation material contains the substituted or unsubstituted μ-oxo-gallium phthalocyanine dimer and the substituted or unsubstituted hydroxy gallium phthalocyanine in a ratio of 30-98/70-2 based on mol-ratio.

2. The photoconductor of claim 1, wherein the charge generation material contains an unsubstituted gallium phthalocyanine dimer and an unsubstituted hydroxy gallium phthalocyanine.

3. The photoconductor of claim 1, wherein the diffraction peaks at the Bragg angles (2θ±0.2) of 7.5° and 28.3° are high diffraction peaks.

4. The photoconductor of claim 1, wherein the charge generation material further has distinctive peaks at the Bragg angles (2θ±0.2) of 9.9°, 12.5°, 16.3°, 18.6° and 25.1° in the Cu-Kα characteristic X-ray diffraction spectrum.

5. The photoconductor of claim 1, wherein the photosensitive layer is a lamination type layer in which a charge generating layer containing the charge generating material and a charge transporting layer are laminated.

6. The photoconductor of claim 5, further comprising a protective layer on the transporting layer.

7. The photoconductor of claim 1, wherein in the charge generation material, the content ratio of the substituted or unsubstituted μ-oxo-gallium phthalocyanine dimer to the substituted or unsubstituted gallium phthalocyanine is 35 mol % or more.

8. The photoconductor of claim 1, wherein in the charge generation material, the mol-ratio of the substituted or unsubstituted μ-oxo-gallium phthalocyanine dimer to the substituted or unsubstituted gallium phthalocyanine is 50/50 to 90/10.

9. The photoconductor of claim 1, wherein in the charge generation material, the sum content of the substituted or unsubstituted μ-oxo-gallium phthalocyanine dimer and the substituted or unsubstituted gallium phthalocyanine is 90 mol % or more of the amount of the charge generation material.

10. The photoconductor of claim 1, wherein the substituted or unsubstituted μ-oxo-gallium phthalocyanine dimer and the substituted or unsubstituted gallium phthalocyanine have a primary grain diameter of 0.01 to 0.5 μm.

11. The photoconductor of claim 10, wherein the primary grain diameter is 0.01 to 0.3 μm.

12. The photoconductor of claim 10, wherein the primary grain diameter is 0.01 to 0.15 μm.

13. An image forming apparatus, comprising:

a photoconductor described in claim 1;

a charging device to charge the photoconductor;

an exposing device to imagewise exposing the charged photoconductor to form a latent image;

a developing device to develop the latent image.

14. The apparatus of claim 13, wherein the diffraction peaks at the Bragg angles (2θ±0.2) of 7.5° and 28.3° are high diffraction peaks.

15. The apparatus of claim 1, wherein the charge generation material further has distinctive peaks at the Bragg angles (2θ±0.2) of 9.9°, 12.5°, 16.3°, 18.6° and 25.1° in the Cu-Kα characteristic X-ray diffraction spectrum.

16. A process cartridge for use in an image forming device, comprising:

a housing; and a photoconductor described in claim 1.

17. The process cartridge of claim 16, wherein the diffraction peaks at the Bragg angles (2θ±0.2) of 7.5° and 28.3° are high diffraction peaks.

18. The process cartridge of claim 17, wherein the charge generation material further has distinctive peaks at the Bragg angles (2θ±0.2) of 9.9°, 12.5°, 16.3°, 18.6° and 25.1° in the Cu-Kα characteristic X-ray diffraction spectrum.

* * * * *